US005649628A

United States Patent [19]

Stevens et al.

[11] Patent Number: 5,649,628

[45] Date of Patent: Jul. 22, 1997

[54] METHOD AND APPARATUS FOR DETERMINING THE ORIENTATION OF A DOCUMENT

[75] Inventors: Mark A. Stevens; William R. Lile, both of Medford, N.J.

[73] Assignee: Opex Corporation, Moorestown, N.J.

[21] Appl. No.: 686,267

[22] Filed: Jul. 25, 1996

Related U.S. Application Data

[63] Continuation of Ser. No. 382,656, Feb. 2, 1995, Pat. No. 5,540,338, which is a continuation of Ser. No. 114,196, Aug. 30, 1993, Pat. No. 5,397,003, which is a continuation of Ser. No. 720,413, Jun. 25, 1991, Pat. No. 5,240,116, which is a continuation-in-part of Ser. No. 363,511, Jun. 8, 1989, Pat. No. 5,115,918, which is a division of Ser. No. 904,966, Sep. 5, 1986, Pat. No. 4,863,037.

[51] Int. Cl.[6] ..... B07C 5/00

[52] U.S. Cl. ..... 209/534; 209/567

[58] Field of Search ..... 209/3.1, 3.3, 534, 209/540, 567, 569, 570, 900

[56] References Cited

U.S. PATENT DOCUMENTS

| | | | |
|---|---|---|---|
| 2,994,428 | 8/1961 | Daubendick | 209/567 X |
| 4,465,192 | 8/1984 | Ohba et al. | 209/534 |
| 4,542,829 | 9/1985 | Emery et al. | 209/534 |
| 4,584,529 | 4/1986 | Aoyoma | 209/567 X |
| 4,734,643 | 3/1988 | Bubenik et al. | 209/567 X |
| 5,402,895 | 4/1995 | Mikkelsen et al. | 209/534 |

*Primary Examiner*—James R. Bidwell

*Attorney, Agent, or Firm*—Dann, Dorfman, Herrell and Skillman, P.C.

[57] ABSTRACT

To identify the orientation of specified documents, such as checks bearing magnetic ink markings, steps are taken to magnetize ink markings associated with the document, and to then detect magnetized ink markings on the document to develop electrical signals which can then be subjected to processing for identifying the orientation of the document based upon certain preestablished criteria. The result is a stand-alone device adapted to operate upon documents which are contained within envelopes to be subjected to an extraction procedure, prior to extraction from the envelopes, achieving a pre-processing of envelopes to identify those which contain the specified documents, and the orientation of the identified documents. The device is similarly adapted to operate upon the extracted documents, to identify those requiring special handling, and their orientation.

6 Claims, 3 Drawing Sheets

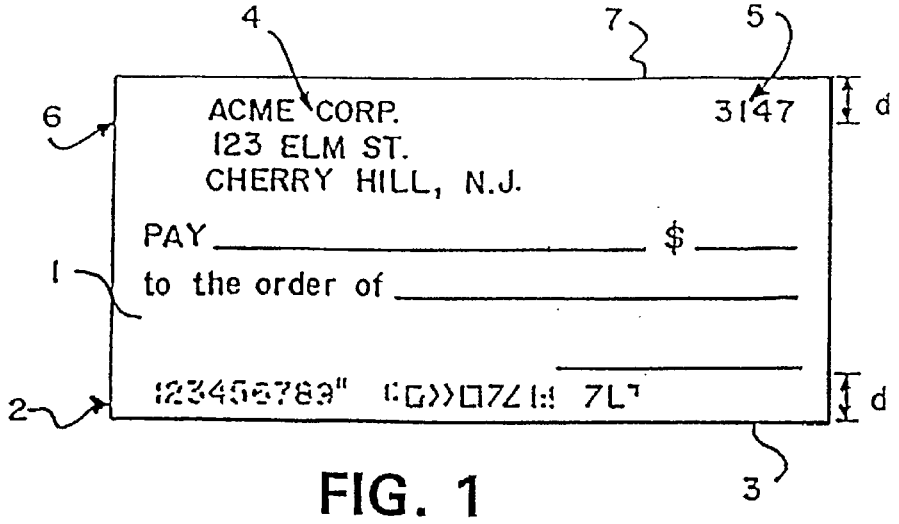
FIG. 1
FIG. 3
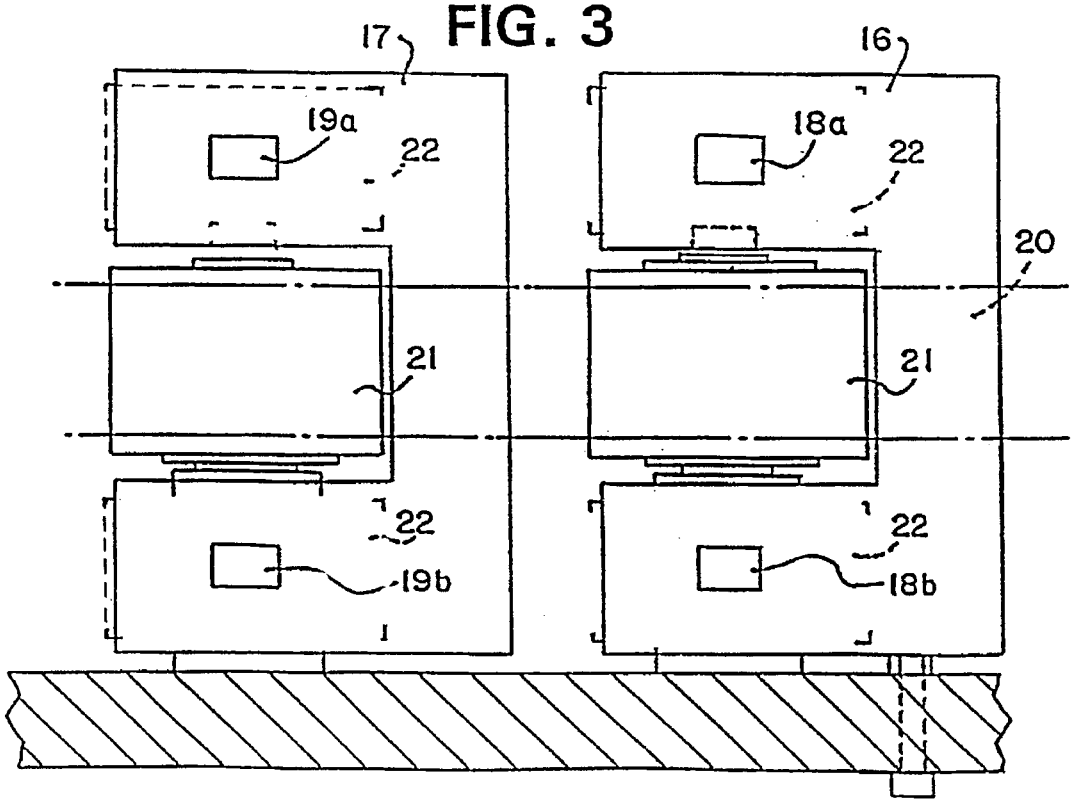

METHOD AND APPARATUS FOR DETERMINING THE ORIENTATION OF A DOCUMENT

RELATED CASES

This is a continuation of U.S. patent application Ser. No. 08/382,656, filed Feb. 2, 1995, which will issue on Jul. 30, 1996, as U.S. Pat. No. 5,540,338, which is itself a continuation of U.S. patent application Ser. No. 08/114,196, filed Aug. 30,1993, now U.S. Pat. No. 5,397,003, dated Mar. 14, 1995, which is itself a continuation of U.S. patent application Ser. No. 07/720,413, filed Jun. 25, 1991, now U.S. Pat. No. 5,240,116, dated Aug. 31, 1993, which itself is a continuation-in-part of U.S. Ser. No. 07/363,511, filed Jun. 8, 1989, now U.S. Pat. No. 5,115,918, dated May 26, 1992, which is itself a divisional of U.S. patent application Ser. No. 06/904,966, filed Sep. 5, 1986, now U.S. Pat. No. 4,863,037, dated Sep. 5, 1989, each of which are hereby incorporated herein by reference.

BACKGROUND OF THE INVENTION

The present invention relates generally to the bulk processing of mail and the like.

For some time, various devices have been developed to facilitate the extraction of contents from envelopes received in a mail room setting. Initially, this involved the development of devices which could be used to receive a plurality of envelopes for extraction of their contents, to serially sever envelope edges and expose the contents for presentation to an operator for manual extraction. One example of this type of apparatus which has found acceptance in the industry is the "Model 50" Rapid Extraction Desk which is manufactured by Opex Corporation of Moorestown, N.J. Later efforts turned to the bulk processing of mail, in fully automated devices which could receive large quantities of envelopes for serial delivery to an apparatus which could sequentially open the envelopes, extract their contents, and orient the extracted contents for subsequent stacking. One example of this type of apparatus which has found acceptance in the industry is the "Model 100" extraction system, which is also manufactured by Opex Corporation of Moorestown, N.J.

The availability of such devices, as well as the ever—present impetus to expedite the processing of certain types of mail (i.e., those containing an invoice and check for deposit), has led to the need for ancillary equipment capable of facilitating the pre-processing of sealed envelopes, prior to an extraction procedure, and the post-processing of documents, following an extraction procedure. In pre-sorting envelopes, it is important to identify envelopes containing checks, and which are therefore to be processed on an expedited basis (to expedite deposit of the extracted checks), as well as to identify the orientation of the checks contained within the envelopes to facilitate their subsequent extraction and processing. In post-sorting extracted documents, it is again important to identify extracted checks, and to identify the orientation of the extracted checks prior to stacking and subsequent processing.

Such pre-processing and post-processing is desirable to facilitate the handling of extracted checks, significantly expediting their processing for deposit (which is the overall objective of mail extraction procedures of this general type).

SUMMARY OF THE INVENTION

It is therefore the primary object of the present invention to provide an improved method and apparatus for determining the orientation of specified documents, primarily checks for deposit.

It is also an object of the present invention to provide a method and apparatus for determining the orientation of specified documents either prior to or subsequent to subjecting the documents to an extraction procedure.

It is also an object of the present invention to provide a method and apparatus for identifying the orientation of specified documents at different stages of a mail extraction procedure, separate from the devices which are used to actually perform the extraction procedure.

These and other objects are achieved in accordance with the present invention by providing a method and apparatus for identifying the orientation of specified documents bearing indicia which are capable of being operated upon by external stimuli. Primarily, this is directed to the magnetic ink markings of checks associated with a remittance processing operation. To this end, steps are taken to magnetize the ink markings associated with the document, and to then detect magnetized ink markings on the document to develop electrical signals which can then be subjected to processing for identifying the orientation of the document based upon certain preestablished criteria.

U.S. Pat. No. 4,863,037 discloses means for performing the foregoing operations in conjunction with an automated mail extraction procedure. In accordance with the present invention, steps are taken to isolate those portions of the apparatus disclosed in U.S. Pat. No. 4,863,037 which accomplish this task, for stand-alone operation. The resulting device is adapted to operate upon documents (primarily checks) which are contained within envelopes to be subjected to an extraction procedure, prior to extraction from the envelopes, achieving a pre-processing of envelopes to identify those which contain the specified documents, and the orientation of the identified documents. The device is similarly adapted to operate upon the extracted documents, to identify those requiring special handling, and their orientation. Irrespective of the manner in which the apparatus is employed, an effective stand-alone device is provided for determining the orientation of specified documents at desired stages of the mail extraction procedure.

For further detail regarding a preferred embodiment apparatus produced in accordance with the present invention, reference is made to the detailed description which is provided below, taken in conjunction with the following illustrations.

BRIEF DESCRIPTION OF THE DRAWINGS

FIG. 1 is a plan view illustrating a check for processing in accordance with the present invention.

FIG. 3 is a sectioned, elevational view of the detection fixture of FIG. 2, taken along the line 3—3.

In the several views provided, like reference numbers denote similar structures.

DETAILED DESCRIPTION OF THE INVENTION

Figure 2:
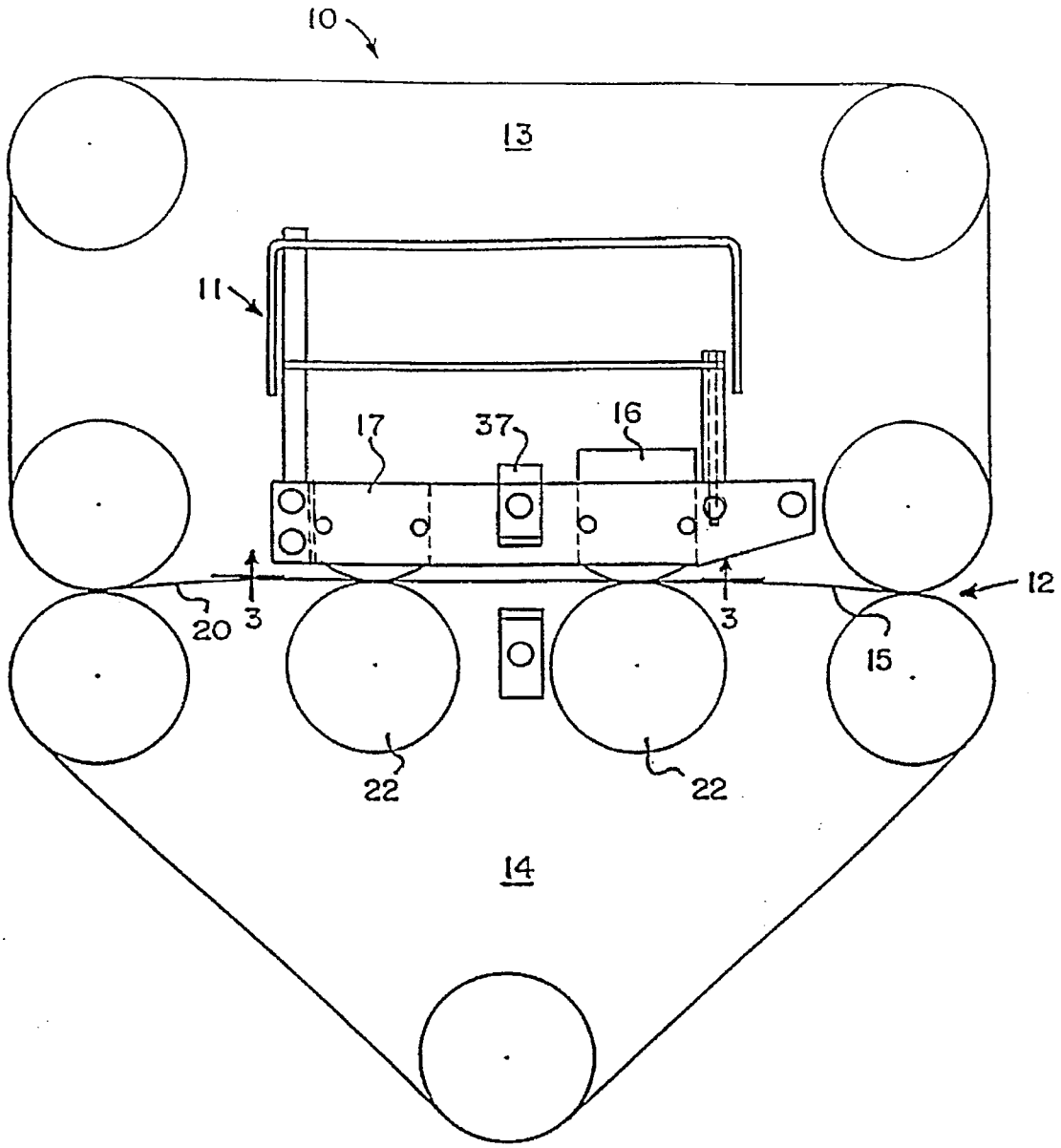
FIG. 2 is a top plan view of a detection fixture for processing documents in accordance with the present invention.

The improvements of the present invention are generally achieved by analyzing the "profile" of a check 1 as revealed by certain of its characteristic features. For example, with reference to FIG. 1, every check 1 must include a MICR (magnetic ink character recognition) "data line" for processing through the banking system. Moreover, this data line, shown at 2, is uniformly placed at a specified distance ("d") from the lower edge 3 of the check, and only the identifying characters which comprise this data line may be placed in this segregated band. This feature therefore constitutes a known characteristic which may serve as a primary basis for making determinations as to orientation. Most checks further include personalized identification fields such as the name of the account owner, and a checking account sequence number. If used, the account name is uniformly placed at 4, while the sequence number is uniformly placed at 5. It has been found that a second data line, shown at 6, which is also spaced at a specified distance ("d") from the top edge 7 of the check, will intersect with the fields 4, 5, if provided, and that only these identifying fields will be found in this segregated band. This feature therefore constitutes a known characteristic which may serve as a secondary basis for making determinations as to orientation. It has been found that by analyzing such characteristic features, along the data lines 2, 6, the orientation of a check 1 can be identified.

To accomplish this, a detection apparatus 10 is provided which, generally speaking, operates upon the magnetic ink which is traditionally used to print conventionally available checks. To be noted is that since the data lines 2, 6 which are to be operated upon are rather precisely spaced from the edges 3, 7 of the check 1 (by the specified distance "d"), it is important for the bottom-most edge of the document being scanned to be at a known and proper location. It is for this reason that the documents to be processed are preferably subjected to a justification step immediately proceeding their introduction to the detection apparatus 10, which may be accomplished either manually, in a tamping procedure, or automatically, making use of an edge justification device of the type disclosed in U.S. Pat. No. 4,863,037.

Referring now to FIGS. 2 and 3, upon entering the detection apparatus 10, documents are presented to a detection fixture 11, entering a nip 12 which is defined between an opposing pair of belt systems 13, 14 which serve to draw the received documents through the detection fixture 11, along a transport path 15. Positioned along the transport path 15 which is developed by the belt systems 13, 14 are a pair of fixtures 16, 17. The fixture 16 includes a pair of charge heads 18*a*, 18*b* which are capable of imparting a magnetic charge to the ink on the checks which are being passed through the detection fixture 11. Downstream from the fixture 16 is a second fixture 17, which includes a pair of read heads 19*a*, 19*b* which are responsive to flux variations resulting from the movement of charged characters (numerals or letters) past the heads 19*a*, 19*b*. To be noted is that the charge heads 18*a*, 18*b* and the read heads 19*a*, 19*b* are respectively positioned above and below the belts 20 of the belt systems 13, 14, so that the heads 18*a*, 18*b*, 19*a*, 19*b* are exposed to the documents being conveyed through the detection fixture 11. Further to be noted is that the heads 18*a*, 18*b*, 19*a*, 19*b* are vertically and symmetrically positioned along the fixtures 16, 17 so that the heads 18*a*, 18*b*, 19*a*, 19*b* will be aligned with each of the data lines 2, 6 of the checks which are being processed through the detection fixture 11, irrespective of the orientation of each check as it progresses through the detection apparatus 10. The reasons for this will become apparent from the description which follows.

To enhance the reading of magnetic flux, it is important for each check to be maintained in proper association with the heads 18*a*, 18*b*, 19*a*, 19*b* as the checks are drawn past the fixtures 16, 17. To this end, a pair of idler rollers 21 are preferably positioned in general alignment with the fixtures 16, 17 to enable careful adjustment of the belts 20 of the belt systems 13, 14 into alignment relative to the plane of the heads 18*a*, 18*b* 19*a*, 19*b*. Paired rollers 22 are further preferably positioned in general alignment with, and spaced from (by a relatively small, adjustable gap) each of the heads 18*a*, 18*b*, 19*a*, 19*b*, on the opposite side of the transport path 15, to facilitate appropriate contact between the check 1 and the heads 18*a*, 18*b* 19*a*, 19*b*. Non-magnetic leaf springs may also be used for this purpose. In any event, as a check is drawn through the detection fixture 11, the ink of the check is magnetized at 18*a*, 18*b*, and read at 19*a*, 19*b*, to provide electrical signals which can then be used to determine the orientation of the check.

In implementation, the detection fixture 11 may form part of a mail extraction apparatus, such as the "Model 100" extraction system manufactured by Opex Corporation of Moorestown, N.J.(and as disclosed in U.S. Pat. No. 4,863,037) or the "Model 50" Rapid Extraction Desk manufactured by that same company. The detection fixture 11 may also form part of a standalone apparatus useful in the pre-processing and post-processing of documents, if desired. For example, in some cases it may be desirable to present sealed envelopes to the detection fixture 11, prior to subjecting the envelopes to an extraction procedure, to identify envelopes containing checks (for expedited processing) and/or to identify the orientation of checks contained by the envelopes (to facilitate their subsequent processing). In other cases, it may be desirable to present extracted documents to the detection fixture 11, following an extraction procedure, to identify checks and/or their orientation to facilitate their subsequent processing.

Irrespective of its manner of implementation, the overall operation of the detection apparatus 10 remains unchanged since the detection fixture 11 is capable of operating either directly upon checks which are exposed to it, or indirectly upon checks contained within an envelope (and which are therefore separated from the detection fixture 11 by one or more paper thicknesses). The only potential variable is that of gain (in operating the charge heads 18*a*, 18*b* and/or the read heads 19*a*, 19*b*), which may be adjusted as needed and in accordance with the particular application involved. Upon detecting the orientation of a particular document, steps may be taken to either record the determined orientation (in memory for subsequent processing) or to develop electrical signals for presentation to document reorienting devices (inverting and/or reversing devices) such as are disclosed in U.S. Pat. No. 4,863,037.

Figure 4:
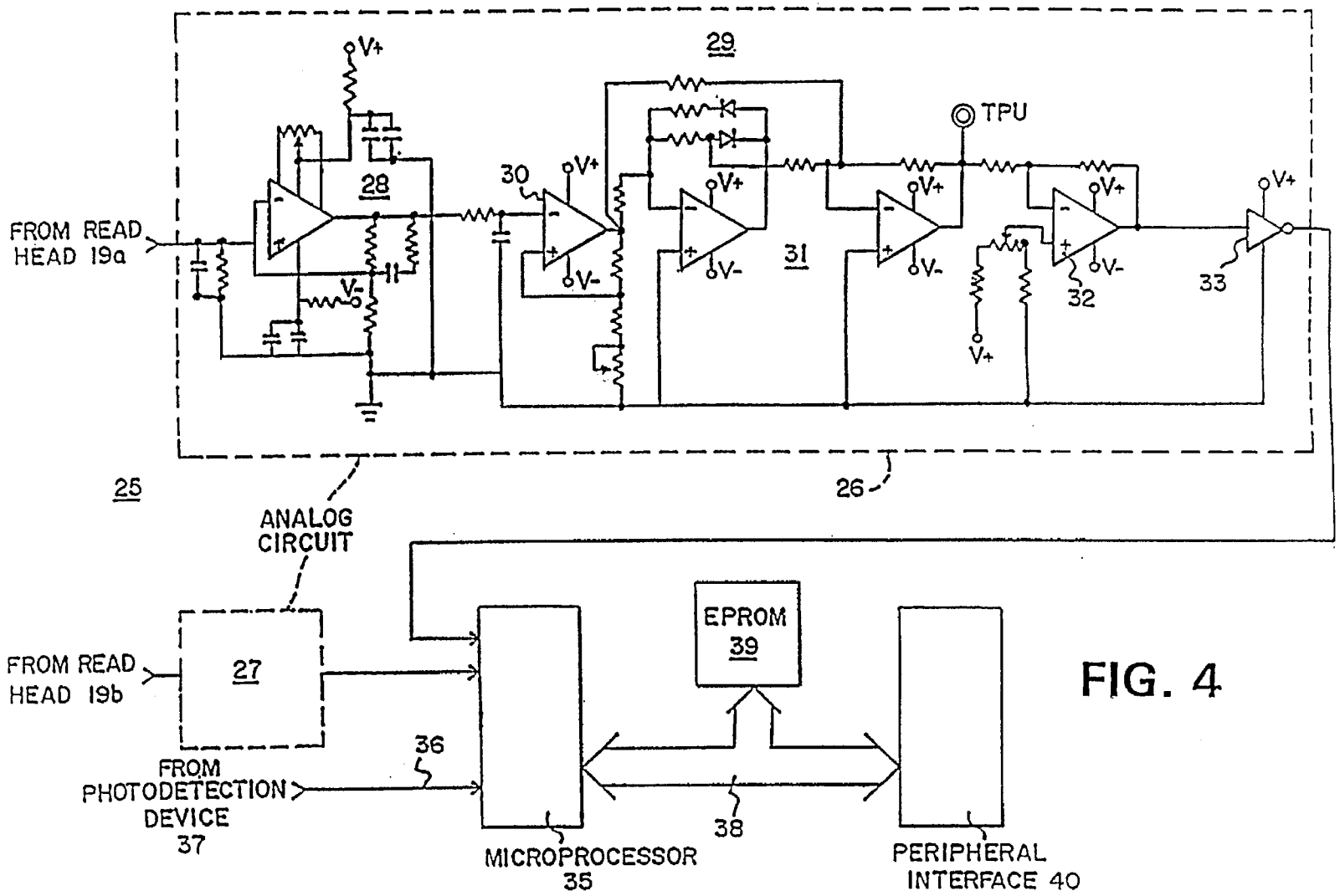
FIG. 4 is a schematic diagram showing a circuit for receiving and processing signals from the detection fixture of FIG. 2.

As documents pass the detection fixture 11 (irrespective of the manner in which the detection apparatus 10 is employed), electrical signals are developed for application to a detection circuit 25 such as is shown in FIG. 4. As previously indicated, a magnetic charge will first be imparted to any magnetic ink markings which are provided along the data lines 2, 6 of the check 1 being scanned as the check passes the charge heads 18*a*, 18*b*. This magnetic charge is preferably imparted to the magnetic ink using a permanent magnet, although electromagnetic means could be employed, if desired. To be noted is that an appropriate charge will be imparted to the magnetic ink characters on the check even if the magnetic ink is separated from the charge heads 18*a*, 18*b* by one or more paper thicknesses, since the desired charge will pass through the paper of the check, or an overlying envelope, as it passes the charge heads 18*a*, 18*b*. Similarly, the read heads 19*a*, 19*b* will operate to read the magnetic markings either directly, or through the check (for post-processing), or through the overlying envelope (for preprocessing), for subsequent interpretation.

Each of the read heads 19*a*, 19*b* are separately coupled to a circuit 26, 27 for respectively processing the analog signals received from the uppermost read head 19*a* and the lowermost read head 19*b*. Each of the circuits 26, 27 are preferably positioned close to the read heads 19*a*, 19*b* to immediately amplify and process the signals which are received from the read heads 19*a*, 19*b*, prior to their introduction to the remainder of the apparatus as will be described more fully below.

The circuits 26, 27 are identical in construction (only the circuit 26 is shown in detail to simplify the drawings), and each include a pre-amplifier 28 for immediately amplifying the signals received from the associated read head (in this case the read head 19*a*). The pre-amplified signal is then applied to a wave shaping circuit 29. Wave shaping circuit 29 includes an amplifier 30 for receiving signals from the pre-amplifier 28, a full-wave rectification circuit 31 which is coupled to the amplifier 30 to receive the amplified signal for full-wave rectification, preferably without any offset, and a differential amplifier 32 to set the final level for maximum noise immunity. Lastly, the wave shaping circuit 29 communicates with a Schmitt trigger circuit 33 which readies the amplified signal for digital processing.

A microprocessor 35 is provided to receive the various signals derived from the read heads 19*a*, 19*b*, via the analog circuits 26, 27, to provide outputs which are indicative of the orientation of the check passing through the detection fixture 11 as will be described more fully below. To this end, the signals from the Schmitt trigger circuits 33 of the analog circuits 26, 27 are applied to the microprocessor 35. Also applied to the microprocessor 35 is an enabling signal 36 which is indicative of the passage of a check through the detection fixture 11, and which serves to initiate the orientation detection scheme to be described below. Passage of the check (the leading edge) through the detection fixture 11 may be detected by various means, such as a photodetection device 37 (see FIG. 2) positioned between the charge heads 18*a*, 18*b* and the read heads 19*a*, 19*b*. A common buss 38 operatively connects the microprocessor 35 with EPROM 39, and a peripheral interface 40 for enabling communication with ancillary equipment 41 (e.g., data recorders or equipment for reorienting documents).

The detection circuit 25 can operate to determine the orientation of two different types of checks including standard personal checks, which never vary in size, as well as commercial checks, which are nearly standard but which may vary to some extent. This is accomplished by magnetizing the ink of the check as previously described, and by reading the magnetized ink as the check passes through the detection fixture 11. Symmetrically paired, upper and lower charge heads 18*a*, 18*b* and read heads 19*a*, 19*b* are provided to enable the desired data to be obtained in a single pass of the check through the detection fixture 11, irrespective of its orientation.

The decision as to the orientation of a check relative to the detection fixture 11 is based not upon an attempt to read portions of the MICR data line 2, but rather results from an interpretive process which is performed within the microprocessor 35. To this end, beginning at a set time after the leading edge of a check passes the photodetection device 37 (to account for the distance,between the photodetection device 37 and the read heads 19*a*, 19*b*), data is provided to the microprocessor 35 which is indicative of the presence or absence of characters encountering the read heads 19*a*, 19*b*. The microprocessor 35 then operates to monitor the length of "continuous" data fields which are encountered at the read heads 19*a*, 19*b*, as well as discontinuities which exist between such data groupings, in accordance with procedures which are presently employed in the above-discussed "Model 100" extraction system. However, for purposes of explanation, a summary of these procedures is provided below.

Within the microprocessor 35, a series of counters are developed to monitor the lengths of marking groups read from the check being scanned, as well as gaps between such marking groups. Separate counters are provided to interpret the data being received from the upper read head 19*a* and the lower read head 19*b*. Since the characters on the data line 2 are conventionally provided at one-eighth inch spacings, a corresponding sampling period is established by the microprocessor 35. If, during the sampling period, a character is passing the read head 19*a* or 19*b*, the microprocessor 35 will operate to count a marking for the corresponding data link. If, during the sampling period, a character does not pass the read head 19*a* or 19*b*, the microprocessor 35 will operate to count a space for the corresponding data line.

For encountered markings, the appropriate marking counter is incremented. If a space counter ever counts more than a specified number (e.g., six) of spaces prior to a resumption of encountered markings, the occurrence is designated as a gap. The appropriate gap counter is incremented and the space counter and marking counter are reset to zero. If markings are again encountered before the space counter counts the specified number of spaces, the occurrence is not designated as a gap, but rather is designated as a space within the marking group. In such cases, the value of the space counter is added to the marking counter, and the space counter is reset to zero. Thus, the encountered spacing is treated as part of a continuous marking group. The various counters proceed in this fashion to identify the length of the last encountered marking group, and the number of any gaps, on each of the data lines 2, 6 of the check 1 being scanned. These values are then used to make a determination as to the orientation of the check 1 based upon various stored, empirically determined criteria (EPROM 39) within the microprocessor 35.

For example, if it is determined that the upper gap counter is non-zero and the lower gap counter is zero, while the upper pulse counter is greater than nine and the lower pulse counter is at least twenty-two, then the check has passed through the detection fixture 11 while upright and facing away from the read heads 19*a*, 19*b*. If it is determined that the lower gap counter is non-zero and the upper gap counter is zero, while the lower pulse counter is less than seven and the upper pulse counter is at least twenty-two, then the check has passed through the detection fixture 11 while inverted and facing away from the read head 19*a*, 19*b*. If it is determined that the lower gap counter is non-zero and the upper gap counter is zero, while the upper pulse counter is at least twenty-two and the lower pulse counter is greater than nine, then the check has passed through the detection fixture 11 while inverted and facing the read head 19*a*, 19*b*. Lastly, if it is determined that the upper gap counter is non-zero and the lower gap counter is zero, while the upper pulse counter is less than seven and the lower pulse counter is at least twenty-two, then the check has passed through the detection fixture 11 while upright and facing the read heads 19*a*, 19*b*.

The above criteria assume that a check having the characteristic features 2, 4, 5 has passed through the detection apparatus 10. However, other types of documents can also be sensed in accordance with the present invention, if desired. For example, in the event that all gap and pulse counters equal zero, it can be assumed that the document is not a check, but rather is a corresponding invoice passing through the detection apparatus 10.

In the event that the document is a check, but does not include either of the fields 4, 5, different criteria may be devised to establish the orientation of such documents. For example, assume that a check does not include a sequence number at 5. Such a document can be analyzed provided a count is made of the gap which extends between the leading edge of the document and the first detected marking group. This may be accomplished by retaining the data which is developed from the start of the count (responsive to the photodetection device 37) to the first encountered marking group. If it is determined that the lower gap counter exceeds the lower leading edge gap counter, the lower pulse counter exceeds twenty-three and the lower pulse counter exceeds the upper pulse counter, then the check has passed through the detection fixture 11 while upright and facing the read head 19*a*, 19*b*. If it is determined that the upper leading edge gap counter exceeds the upper gap counter, the upper pulse counter exceeds twenty-three and the upper pulse counter exceeds the lower pulse counter, then the check has passed through the detection fixture 11 while inverted and facing the read head 19*a*, 19*b*. If it is determined that the upper gap counter exceeds the upper leading edge gap counter, the upper pulse counter exceeds twenty-three and the upper pulse counter exceeds the lower pulse counter, then the check has passed through the detection fixture 11 while inverted and facing away from the read head 19*a*, 19*b*. Lastly, if it is determined that the upper leading edge gap counter exceeds the upper gap counter, the lower pulse counter exceeds twenty-three and the lower pulse counter exceeds the upper pulse counter, then the check has passed through the detection fixture 11 while upright and facing away from the read head 19*a*, 19*b*.

Other detection schemes (criteria) may be derived to determine the orientation of still other types of checks in similar fashion.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for determining the orientation of a document receivable in differing orientations relative to said apparatus, said document including magnetic ink markings on a surface of the document, and said apparatus comprising:

a) a document transport for transporting the document along a selected path of movement;

b) a magnetizing element along the path of movement for magnetizing the magnetic ink markings on said document;

c) a detector along the path of movement for detecting magnetized ink markings on said document; and d) orientation-determination means responsive to the detector for determining patterns of magnetic ink markings detected by the detector and for determining that said document is in a first defined orientation, or that said document is in some other orientation different from the first orientation dependant on the patterns of magnetic ink markings determined for the document.

2. The apparatus of claim 1 wherein the orientation-determination means is responsive to the detector for determining that said document is at least in a second defined orientation.

3. The apparatus of claim 1 wherein the orientation-determination means is responsive to the detector for determining that said document is in a least one of four defined orientations.

4. A method for determining the orientation of a document receivable in differing orientations, said document including magnetic ink markings on a surface of the document, and said method comprising the steps of:

a) magnetizing the magnetic ink markings on said document;

b) detecting magnetized ink markings on said document;

c) determining patterns of the magnetic ink markings detected on said document; and d) determining that said document is in a first defined orientation, or that said document is in some other orientation different from the first orientation dependent on the patterns of ink markings determined for the document.

5. The method of claim 4 including the step of determining that said document is in at least a second defined orientation.

6. The method of claim 4 including the step of determining that said document is in one of at least four defined orientations.

* * * * *